US006867556B2

(12) United States Patent
Arimoto et al.

(10) Patent No.: US 6,867,556 B2
(45) Date of Patent: Mar. 15, 2005

(54) DEVICE FOR OPERATING A HIGH PRESSURE DISCHARGE LAMP

(75) Inventors: Tomoyoshi Arimoto, Hyogo-ken (JP); Yoshikazu Suzuki, Yokohama (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/681,215

(22) Filed: Oct. 9, 2003

(65) Prior Publication Data

US 2004/0075392 A1 Apr. 22, 2004

(30) Foreign Application Priority Data

Oct. 9, 2002 (JP) ..... 2002-295864

(51) Int. Cl.[7] ..... G05F 1/00
(52) U.S. Cl. ..... 315/291; 315/307; 315/224
(58) Field of Search ..... 315/106, 174, 315/224, 291, 307, 362; 313/570, 574, 617; 445/26

(56) References Cited

U.S. PATENT DOCUMENTS 5,109,181 A 4/1992 Fischer et al. ..... 313/571
5,497,049 A 3/1996 Fischer ..... 313/634
6,545,430 B2 4/2003 Ono et al. ..... 315/291
6,605,906 B2 * 8/2003 Okamoto et al. ..... 315/291
6,670,780 B2 * 12/2003 Ono et al. ..... 315/291
2001/0038267 A1 * 11/2001 Ono et al. ..... 315/106

* cited by examiner

*Primary Examiner*—Don Wong
*Assistant Examiner*—Jimmy Vu
(74) *Attorney, Agent, or Firm*—Nixon Peabody LLP; David S. Safran

(57) ABSTRACT

Alternating current with rectangular waves is supplied from an operating device to an ultra-high pressure discharge lamp in which located within a silica glass discharge vessel is a pair of opposed electrodes separated by a distance of less than or equal to 1.5 mm. A discharge vessel is filled with greater than or equal to 0.15 mg/mm$^3$ mercury and bromine in the range of $10^{-6}$ $\mu$mol/mm$^3$ to $10^{-2}$ $\mu$mol/mm$^3$. In the operating device, a multiplication device computes the discharge wattage supplied to the discharge lamp and controlled so that in the case of a reduction of the operating voltage of the discharge lamp the discharge wattage is reduced, and that in the case of an increase of the operating voltage of the discharge lamp the discharge wattage is increased.

6 Claims, 12 Drawing Sheets

DEVICE FOR OPERATING A HIGH PRESSURE DISCHARGE LAMP

BACKGROUND OF THE INVENTION

1. Field of the Invention

The invention relates generally to a device for operating a high pressure discharge lamp. The invention relates more specifically to an ultra-high pressure AC discharge lamp in which an arc tube is filled with greater than or equal to 0.15 $mg/mm^3$ mercury, in which the mercury vapor pressure during operation is greater than or equal to 110 atm, and that can be used as a projection light source for a projection type projection device or the like.

2. Description of the Related Art

In projection-type projector devices there is a significant demand to be able to illuminate images onto a rectangular screen in a uniform manner and with adequate color rendering. The light source is a metal halide lamp filled with mercury and a metal halide. As the projection devices have developed, the size of metal halide lamps has decreased and more light sources have been produced employing extremely small distances between the electrodes.

Recently, instead of metal halide lamps, high-pressure discharge lamps with an extremely high mercury vapor pressure, for example with greater than or equal to 200 bar (197 atm), have been used. By using high-pressure discharge lamps, the broadening of the arc is suppressed by increased mercury vapor pressure, and the arc is compressed and a great increase of light intensity results.

Recently, there has been a focus on smaller and smaller projector devices. In the discharge lamp for the above-described projector device, on the one hand, there has been a demand for high light intensity and the ability to maintain illuminance. On the other hand, due to the reduction in size of the projector device, there is also a demand for smaller discharge lamps. Therefore, smaller devices and smaller power sources are being used. Thus, a reduction in the voltage during starting (i.e., a property to facilitate starting) is expected.

For the above-described lamp, for example, an ultra-high pressure discharge lamp is used. Located in a silica glass arc-tube is a pair of electrodes a distance of less than or equal to 2 mm apart. The arc-tube is filled with greater than or equal to 0.15 $mg/mm^3$ mercury, rare gas and halogen in the range from $1\times10^{-6}$ $\mu mole/mm^3$ to $1\times10^{-2}$ $\mu mole/mm^3$ (for example, see U.S. Pat. No. 5,109,181 (corresponding to JP-A-2-148561) and U.S. Pat. No. 5,497,049 (corresponding to Japanese patent specification 2980822)). One such discharge lamp and the operating device for it are disclosed, for example, in U.S. Pat. No. 6,545,430 (corresponding to JP-A-2001-312997).

In the high pressure discharge lamp disclosed in U.S. Pat. No. 6,545,430 B2, at a mercury vapor pressure within the tube of 15 MPa to 35 MPa in steady-state operation, the arc tube is filled with a halogen material in the range from $1\times10^{-6}$ $\mu mol/mm^3$ to $1\times10^{-2}$ $\mu mol/mm^3$. Placing a pair of electrodes within the arc tube and placing a projection in the vicinity of the middle of the electrode tip area suppresses the arc jump phenomenon. An AC voltage is applied by an operating device which consists of a DC/DC converter, a DC/AC inverter and a high voltage generation device between the pair of electrodes.

In such an ultra-high pressure discharge lamp, the phenomenon that occurs on the tips of the opposed tungsten electrodes in the arc tube is that, during operation, projections are formed and grow. These projections arise and grow dramatically especially if AC operation is carried out with a distance between the electrodes of less than or equal to 1.5 mm, an amount of mercury of greater than or equal to 0.15 $mg/mm^3$ and an amount of halogen (e.g., bromine or the like) of $10^{-6}$ $\mu mol/mm^3$ to $10^{-2}$ $\mu mol/mm^3$. The phenomenon in which the projections are formed on the electrode tips cannot always be unambiguously explained, but the following can be assumed.

In one such discharge lamp, the arc tube is filled with a halogen gas. The main objective is to prevent devitrification of the arc tube. The halogen gas also yields the so-called halogen cycle. The tungsten, which during lamp operation is vaporized from the area with a high temperature in the vicinity of the electrode tip, reacts with the halogen and the remaining oxygen which is present within the arc tube, and a tungsten compound is formed such as WBr, $WBr_2$, WO, $WO_2$, $WO_2Br$, $WO_2Br_2$ or the like, if, for example, the halogen is Br. These compounds decompose in the area with a high temperature in the gaseous phase in the vicinity of the electrode tip, and become tungsten atoms or cations. The tungsten atoms are transported by thermal diffusion (diffusion of the tungsten atoms from the high temperature region in the gaseous phase, (i.e., from the arc) to the low temperature region, (i.e., the vicinity of the electrode tip)) and in the arc, become cations and, during operation of the cathode, are pulled by the electrical field in the direction to the cathode (drift). In this way, the density of the tungsten vapor in the gaseous phase in the vicinity of the electrode tip is increased and is precipitated on the electrode tip, thereby forming projections.

These projections have the effect that they can prevent the arc jump. If, in the course of continued operation of the lamp, the projections grow, the disadvantage arises that the distance between the electrodes is reduced, the position of the arc radiance spot is changed and that the light intensity is reduced.

In the above-described U.S. Pat. No. 6,545,430 B2 it is shown that by the formation of the projection, the lamp voltage fluctuates (decreases). Furthermore, it is disclosed that in the case of a change in the lamp voltage (i.e., the distance between the electrodes) by the formation of the projection by controlling the amount of current flowing between the two electrodes and by switching the first frequency of the operation frequency to a second frequency, the fluctuation of the lamp voltage by the formation of the projection is corrected.

For example, with respect to the amount of current flowing between the two above-described electrodes, the following is shown:

In the case in which the lamp voltage (i.e., distance between the electrodes) becomes smaller than the normal value, the length of the projection is reduced by increasing the discharge arc current which flows between the two electrodes, by which the lamp voltage increases (i.e., rises). In the case in which the lamp voltage (i.e., distance between the electrodes) becomes greater than the normal value, the length of the projection is increased by the reduction of the discharge arc current.

Based on these ideas, in the operating device described in U.S. Pat. No. 6,545,430 B2, a higher discharge arc current is allowed to flow if the determined lamp voltage is less than the reference voltage. Furthermore, the above-described DC/DC converter is controlled with feedback such that the discharge arc current is reduced when the lamp voltage is higher than the reference voltage. Thus, the fluctuation of the lamp voltage is suppressed.

It can be envisioned that the control of the change of the distance between the electrodes by the discharge arc current described in U.S. Pat. No. 6,545,430 B2 is effective in certain cases. It was, however, found that the growth of the projections cannot be advantageously controlled.

In U.S. Pat. No. 6,545,430 B2 a higher discharge arc current is allowed to flow in the case in which the determined value of the lamp voltage is lower than the reference voltage. Furthermore, the discharge arc current is reduced when the value of the lamp voltage is higher than the reference voltage. As a result, it was however found that the growth of projections cannot always be advantageously controlled by this type of control. U.S. Pat. No. 6,545,430 especially discloses a process for two-stage alteration of the discharge current. Since in this control the lamp voltage changes rapidly, as can be imagined, stable maintenance of the lamp voltage and of the distance between the electrodes becomes difficult.

SUMMARY OF THE INVENTION

Exemplary embodiments of the invention are provided to eliminate the above-described disadvantages in the prior art. An object of the invention is to provide a device for operating a high pressure discharge lamp in which the lamp voltage and the distance between the electrodes of an ultra-high pressure discharge lamp can be kept stable, in which a pair of electrodes located in a silica glass discharge vessel are separated by a distance less than or equal to 1.5 mm and in which the discharge vessel is filled with greater than or equal to 0.15 mg/mm$^3$ mercury and bromine in the range of $10^{-6}$ $\mu$mol/mm$^3$ to $10^{-2}$ $\mu$mol/mm$^3$.

It has been discovered that in the case of a change of the distance between the electrodes by the formation of projections on the electrode tip that neither control of the discharge current nor switching of the operating frequency in the manner described in U.S. Pat. No. 6,545,430 B2 is effective, but that uninterrupted control of the wattage (i.e., discharge wattage) which is supplied to the discharge lamp according to the lamp voltage (i.e., operating voltage) is effective.

In an exemplary embodiment of the invention, the discharge wattage of a ultra-high pressure discharge lamp (hereinafter called the "discharge lamp" or simply "lamp") is controlled as follows:

(i) In the case of a reduction of the operating voltage of the discharge lamp, control is exercised such that the discharge wattage decreases. At the same time, control is exercised such that in the case of an increase of the operating voltage of the discharge lamp, the discharge wattage is increased. Control of the discharge wattage is carried out with respect to the change of the operating voltage without interruption. Therefore, the operating voltage of the discharge lamp is determined, the discharge wattage is increased according to the increase in the operating voltage, without interruption, and the discharge wattage is reduced according to the reduction in the operating voltage, also without interruption; and (ii) The control of the discharge wattage according to (i) is carried out in the range from 0.2 W/V to 1.0 W/V.

In U.S. Pat. No. 6,545,430 B2, a higher discharge arc current is allowed to flow in the case in which the determined value of the lamp voltage is less than the reference voltage. Furthermore, control is exercised such that when the value of the lamp voltage is greater than the reference voltage, the discharge arc current is reduced. Specifically, in Table 5 and in paragraphs 0061 to 0064 of JP-A-2001-312997 (corresponding to U.S. Pat. No. 6,545,430) it is shown that the lamp voltage has decreased on average to 55.1 V, if a lamp with an average initial lamp voltage of 61.2 V at a discharge current of 2.45 A has been operated for 10 hours. The lamp voltage is increased on average to 57.4 V if then the lamp has been operated at a discharge current of 2.75 A for 10 hours.

Since the initial lamp voltage is 61.2 V and the discharge current is 2.45 A, the wattage supplied at the start to the lamp is roughly 150 W. The lamp voltage decreases within the initial ten hours from 61.2 V to an average 55.1 V (the distance between the electrodes is reduced). The power upon termination of the initial ten hours of operation is 135 W (average 55.1 V×2.45 A=135 W).

The wattage during starting of the next ten hours of operation is 152 W (average 55.1 V×2.75 A=152 W) (>135 W). The lamp voltage is increased by ten hours of operation at a discharge current of 2.75 A to an average 57.4 V. The wattage in this instance is 158 W.

In U.S. Pat. No. 6,545,430 B2 the attempt is made in the case of a reduced distance between the electrodes to increase the discharge current and the distance between the electrodes. From the standpoint of wattage, as was described above, the wattage rises from 135 W to 152 W if the lamp voltage is to be increased (i.e., the distance between the electrodes is to be increased).

As described above, with respect to U.S. Pat. No. 6,545,430 B2, the discharge current is increased when an attempt is made to increase the distance between the electrodes. As a result, the discharge wattage is increased. In an exemplary embodiment of the present invention, the discharge wattage is reduced when the operating voltage of the discharge lamp has been reduced (i.e., in the case in which the distance between the electrodes has been reduced). Thus, the distance between the electrodes is increased. Furthermore, the discharge wattage is increased and the distance between the electrodes is reduced when the operating voltage of the discharge lamp has been increased (i.e., in the case in which the distance between the electrodes has been increased).

It can be assumed that this difference results from the difference between the discharge lamp, described in the aforementioned publication, and the discharge lamp of the present invention, with respect to the thermal design of the electrodes and the amount of added halogen. In the discharge lamp of the present invention, the discharge wattage has a stronger effect on the formation of projections than the discharge current. According to the present invention, the distance between the electrodes can be effectively controlled by controlling the discharge wattage.

U.S. Pat. No. 6,545,430 B2 discloses that by increasing the discharge current, the temperature of the tip area of the electrode rises, that the length of the projection part is reduced and that the lamp voltage is increased. However, the present invention provides that when the temperature of the tip area of the electrode increases, the lamp voltage rather drops. Since the entry of the tungsten into the gaseous phase increases, deposition of the tungsten in the tip area of the electrode increases and as a result the formation of the projection is accelerated.

In accordance with an exemplary embodiment of the present invention, the discharge wattage of a discharge lamp is controlled based on the operating voltage of the discharge lamp. Specifically, the device of the present invention includes a voltage detector for determining the operating voltage of the discharge lamp, a means for computing the wattage, supplied to the discharge lamp based on the output of the voltage detector and a current detector, a reference signal generator that produces reference wattage signals that change according to the operating voltage determined by the voltage detector, and a comparator which compares the reference wattage signals to the computed wattage, wherein the operating device is controlled based on the output of the comparator.

It is desirable for the ratio of the change of the discharge wattage according to the change of the operating voltage (i.e., the slope of the above-described wattage setting signal according to the change of the operating voltage) in the control of the discharge wattage according to the operating voltage, to be in a range from 0.2 W/V to 1.0 W/V. By setting said ratio to this range, the distance between the electrodes can be effectively controlled.

Furthermore, as is described in the following, the discharge wattage need not always linearly change. Instead, the above-described ratio can be changed according to the value of the operating voltage, if it remains within the above-described range. Moreover, the wattage setting signal can be kept constant with respect to the change of the operating voltage if the value of the operating voltage is greater than or equal to a certain value, less than or equal to a certain value or within a certain range.

For a more complete understanding of the present invention and for further features and advantages, reference is now made to the following detailed description and the accompanying drawings.

DETAILED DESCRIPTION OF THE INVENTION

Figure 1A:
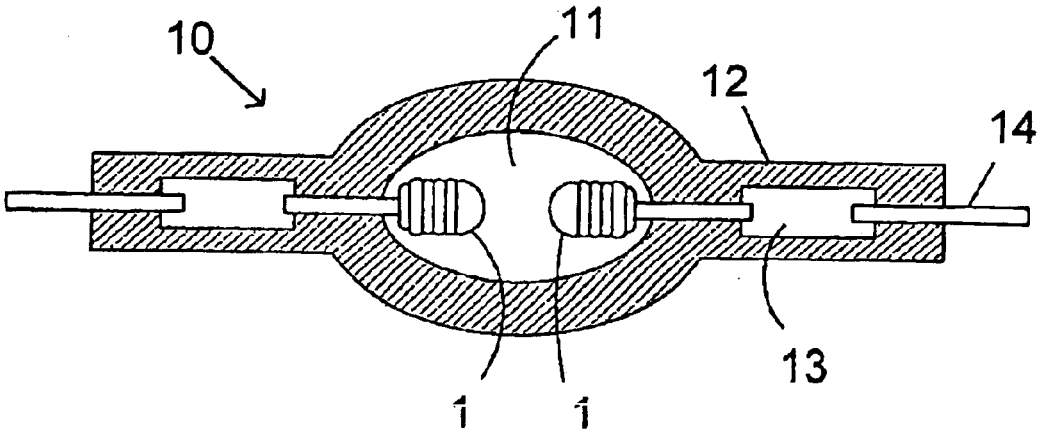
FIGS. 1(*a*) & 1(*b*) each show a schematic of an ultra high pressure discharge lamp in accordance with an exemplary embodiment of the invention.
Figure 1B:
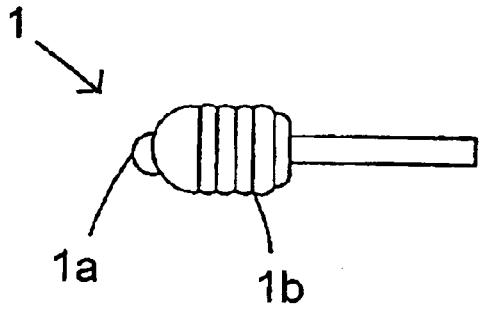

FIG. 1(*a*) shows the overall arrangement of an ultra-high pressure discharge lamp 10 of the AC operating type in accordance with a preferred embodiment of the present invention. The discharge lamp 10 has a substantially spherical light emitting part 11 which is formed by a silica glass discharge vessel. In this light emitting part 11, there are a pair of opposed electrodes 1. Hermetically sealed parts 12 are formed such that they extend to the two ends of the light emitting part 11. In the hermetically sealed parts 12, a conductive metal foil 13 which normally comprises molybdenum is hermetically installed, for example, by a pinch seal. The shaft portions of the pair of electrodes 1 are each electrically connected to the metal foil 13 by welding. The outer lead 14 which projects to the outside is welded to the other end of the respective metal foil 13.

The light emitting part 11 is filled with mercury, a rare gas and a halogen gas. The mercury is used to obtain the necessary wavelength of visible radiation, for example for obtaining radiant light with wavelengths from 360 nm to 780 nm, and is added in an amount of greater than or equal to 0.15 mg/mm$^3$. During operation, this added amount achieves an extremely high vapor pressure of greater than or equal to 150 atm depending on the temperature condition. By adding a larger amount of mercury, a discharge lamp with a high mercury vapor pressure during operation of greater than or equal to 200 atm or greater than or equal to 300 atm can be produced. The higher the mercury vapor pressure the more suitable the light source can be implemented for a projector device.

The rare gas contributes to improving the starting property and, for example, roughly 13 kPa argon gas is used as the rare gas.

The halogens employed with the present invention can be iodine, bromine, chlorine and the like in the form of a compound with mercury or another metal. The amount of halogen added is selected from the range from $10^{-6}$ $\mu$mol/mm$^3$ to $10^{-2}$ $\mu$mol/mm$^3$. The halogen is intended to prolong the service life using the halogen cycle. For an extremely small discharge lamp with a high internal pressure, as in the discharge lamp of the present invention, the main objective of adding this halogen is to prevent devitrification of the discharge vessel.

The numerical values of the discharge lamp are shown by way of example below.

They are, for example, as follows:

the maximum outside diameter of the light emitting part is 9.5 mm;

the distance between the electrodes is 1.5 mm;

the inside volume of the arc tube is 75 mm$^3$;

the nominal voltage is 80 V and the nominal wattage is 150 W.

The discharge lamp 10 is operated using alternating current (AC). The discharge lamp can be located in a projector device which is as small as possible. On the one hand, the overall dimensions of the discharge lamp are extremely small, and on the other hand there is a demand for more light. The thermal effect within the arc tube portion of the lamp is therefore extremely large. The value of the wall load of the lamp is 0.8 W/mm$^2$ to 2.0 W/mm$^2$, specifically 1.5 W/mm$^2$.

Radiant light with good color reproduction can be obtained by such a high mercury vapor pressure and such a high value of the wall load in the case of installation in a presentation apparatus such as the above-described overhead projector, or the like.

On the electrode tip, as shown in FIG. 1(*b*), a projection 1*a* is formed. Behind the spherical part of the electrode tip a coil 1*b* is provided. This coil 1*b* is used for the operating starting property and for heat radiation in steady-state operation, and is preferred in the invention, but not essential.

Figure 2:
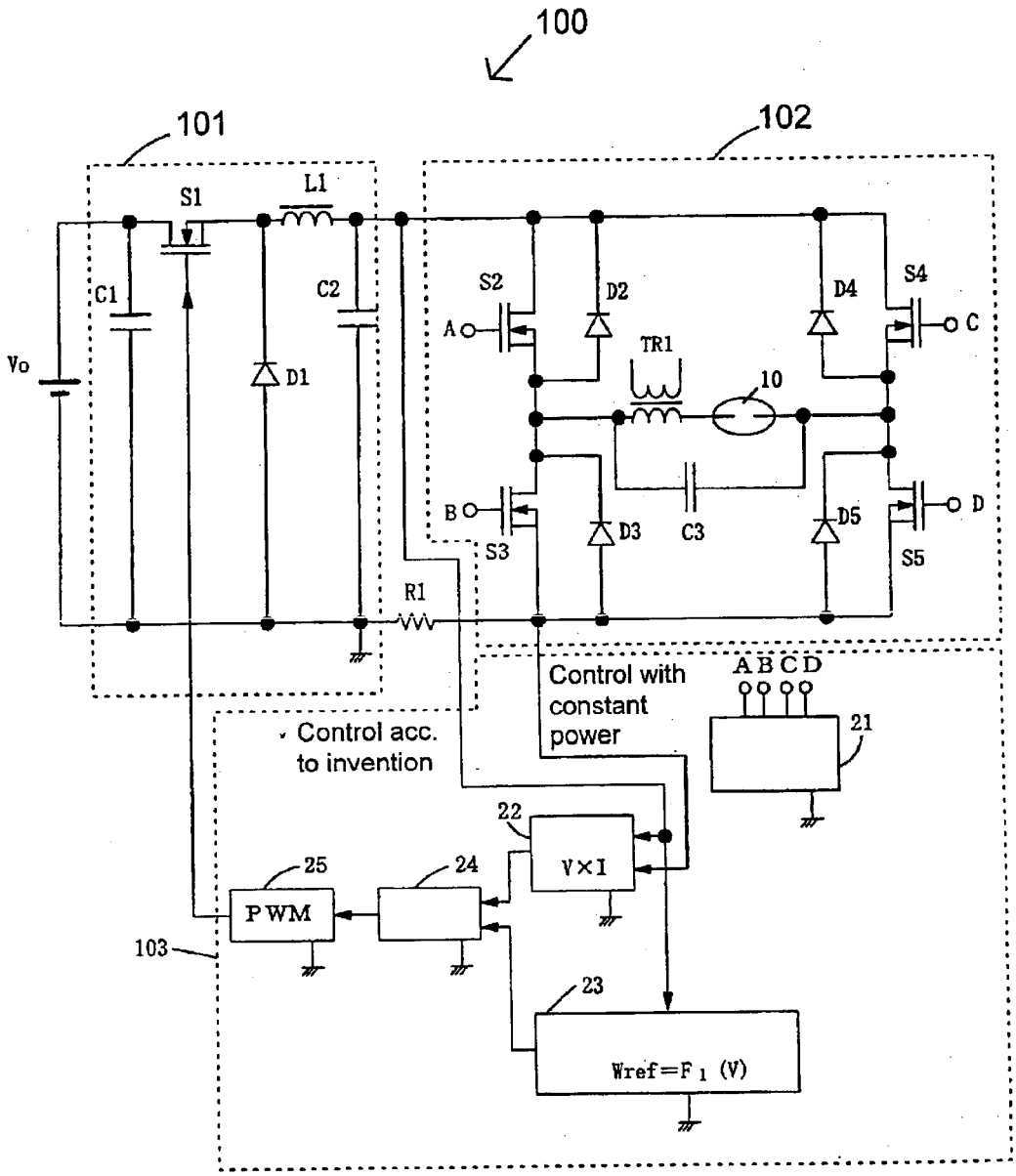
FIG. 2 shows a schematic of one embodiment of the arrangement of an operating device in accordance with an exemplary embodiment of the invention.

FIG. 2 shows one embodiment of the arrangement of an operating device (i.e., feed device) of the invention. FIG. 2 shows one example of the arrangement of the operating device for controlling the illumination wattage according to the operating voltage.

In FIG. 2, reference number 100 represents the operating device which comprises a switching part 101, a full bridge circuit 102 and a control element 103. Control element 103 controls switching part 101 and the full bridge circuit 102. The full bridge circuit 102 includes switching devices S2 to S5 that convert the DC power of the switching part 101 into AC power using rectangular waves. The switching part 101 controls the wattage by pulse width control of the switching device S1.

A transformer TR1 for starting is series connected to the discharge lamp 10.

A capacitor C3 is parallel-connected to the discharge lamp 10 and the transformer TR1. Alternating current (AC) waves having a rectangular shape from the full-bridge circuit 102 are supplied to the series connection of the discharge lamp 10 and the transformer TR1, thereby operating the discharge lamp. The circuit which consists of the discharge lamp 10, the transformer TR1 and the capacitor C3 can also be known as "discharge lamp circuit".

The switching part 101 includes the capacitor C1, the switching device S1 that carries out the switching operation by the output from the control element 103, a diode D1, an inductance L1 and a smoothing capacitor C2. The ON/OFF ratio of the switching device S1 is controlled by a pulse width modulator (PWM) 25 of the control element 103. Via the full-bridge circuit 102, the wattage supplied to the discharge lamp 10 (i.e., the discharge wattage) is controlled. To determine the current which is supplied by the switching part 101 to the discharge lamp 10, a resistor R1 is employed to determine the current between the switching part 101 and the full-bridge circuit 102. The full-bridge circuit 102 includes the switching devices S2 to S5 which comprise a transistor or a FET that are connected like a bridge, and of diodes D2 to D5 which are connected anti-parallel to the switching devices S2 to S5. The switching devices S2 to S5 are driven by the full bridge driver circuit 22 which is located in the control element 103. A discharge lamp 10 is operated by supplying an AC current with rectangular waves.

Thus, the switching devices S2, S5 and the switching devices S3, S4 are turned on in alternation, AC waves with a rectangular shape are supplied to the discharge lamp 10 in the line path as follows: switching part 101→switching device S2→discharge lamp 10→switching device S5→switching part 101, and in the line as follows: path switching part 101→switching device S4→discharge lamp 10→switching device S3→switching part 101 to thereby operate the discharge lamp 10.

The control element 103 has a full bridge driver circuit 21 that produces driver signals for the switching devices S2 to S5. Furthermore, the control element 103 has a multiplication device 22 and a reference wattage signal generator 23. The reference wattage signal generator 23 outputs reference wattage signals [$Wref=F_1(V)$] that correspond to the voltage, (i.e., operating voltage V) on the two ends of the capacitor C2. The multiplication device 22 multiplies the lamp current which has been determined by the resistor R1 for determining the current by the lamp voltage (i.e., operating voltage) and computes the wattage supplied to the discharge lamp 10.

The comparator 24 compares the wattage computed by the multiplication element device 22 to the reference wattage signal, Wref, that is output by the reference wattage signal generator 23 and sends the comparison result to the PWM 25. The PWM 25 produces pulse signals with a duty, at which the above-described wattage and the value of the reference wattage become the same, and subjects the switching device S1 to PWM control.

Using the operating device of this embodiment, the wattage supplied to the discharge lamp (i.e., discharge wattage, also called lamp wattage) is controlled in the manner described below. Based on the voltage (i.e., operating voltage) on the two ends of the capacitor C2 and based on the voltage on the two ends of the resistor R1 for determining the current, the multiplication device 22 computes the power supplied to the discharge lamp 10. The voltage signal, which is proportional to the wattage computed by the multiplication device 22 and supplied to the discharge lamp 10, and the reference wattage signal Wref, which is produced by the reference voltage signal generator 23 according to the above-described operating voltage and is proportional to the discharge wattage to be achieved, are sent to the comparator 24. The output voltage of the comparator 24 is input into the PWM part 25 which subjects the switching device S1 to pulse width control. The PWM part 25 carries out pulse width control of the switching device S1 such that the output voltage of the comparator 24 reaches zero. The output of the circuit 101 is input into the full bridge circuit 102, in the full-bridge circuit 102 is converted into AC waves with rectangular shape and supplied to the discharge lamp 10. As a result the wattage which is to be reached and which corresponds to the operating voltage is supplied to the discharge lamp 1.

Figure 3:
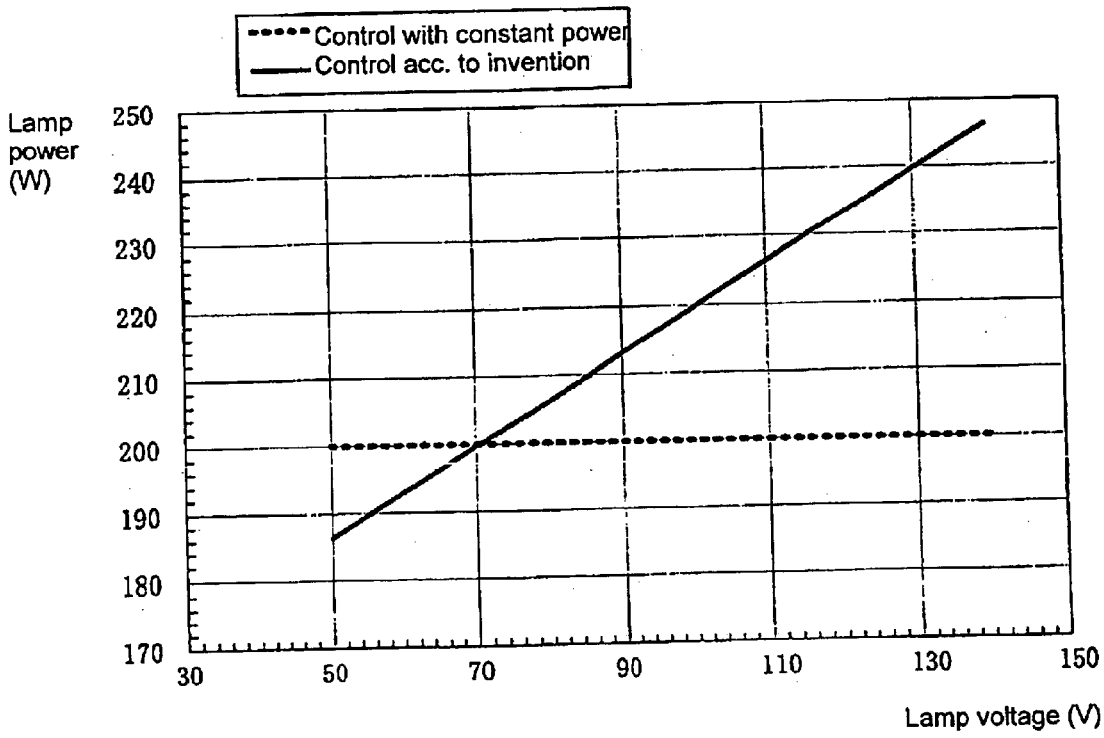
FIG. 3 shows a schematic of the power control curve.

FIG. 3 shows one example of the control curve of the wattage produced by the reference wattage signal generator 23. In FIG. 3, the X-axis plots the lamp voltage (V) and the Y-axis plots the lamp wattage (reference wattage signal Wref). In this embodiment, as shown by the solid line in FIG. 3, according to the change of the lamp voltage V the lamp wattage was changed linearly with a ratio of 0.66 W/V. The broken line in FIG. 3 is a control curve of the wattage in the case of a constant power control.

As is shown in FIG. 3, when the lamp voltage is increased the lamp wattage increases accordingly without interruption, and-when the lamp voltage decreases the lamp wattage is accordingly reduced without interruption. In this way, it is possible to keep the distance between the electrodes constant, even if projections are formed on the electrode tips of the lamp 10.

Figure 4:
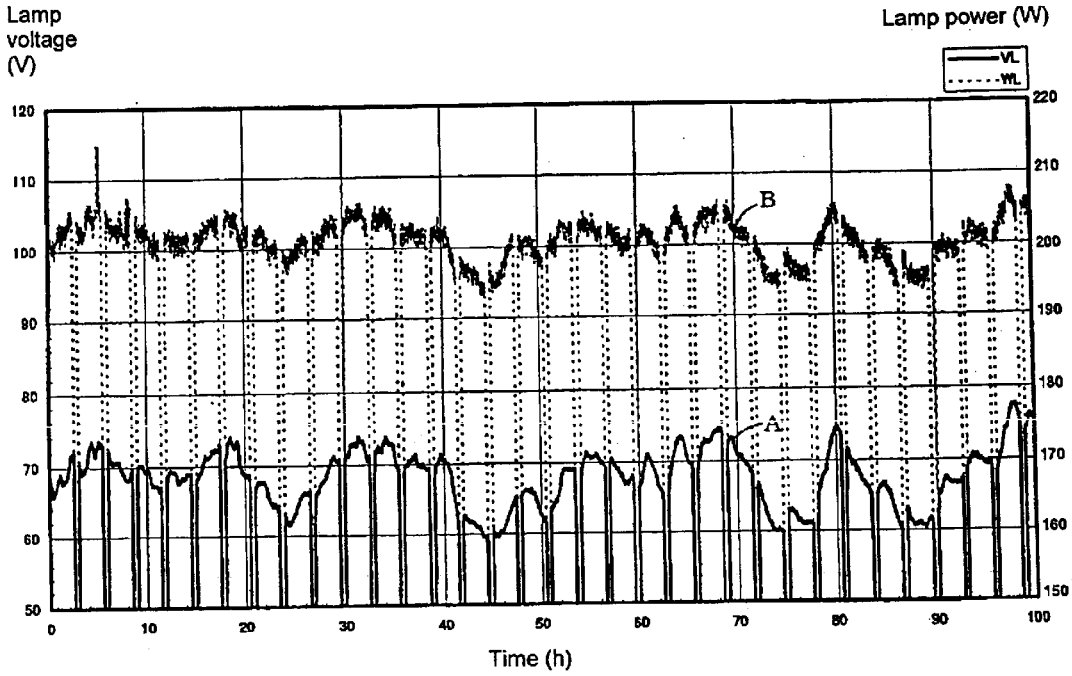
FIG. 4 shows a schematic of the change of the lamp voltage and the lamp wattage during operation by the power control (0.66 W/V) in one embodiment of the invention.

FIG. 4 shows the change of the lamp voltage (V) and the lamp wattage (W) in the case of control of the lamp wattage using the above-described control curve of wattage. Here the X axis plots the running time (h), reference letter A represents the lamp voltage and reference letter B labels the lamp wattage. FIG. 4 shows the state of the illumination wattage and the operating voltage of the discharge lamp for roughly 100 hours of operation of a discharge lamp with nominal values of 200 W and 70 V by power control (0.66 W/V, illumination frequency 150 Hz). FIG. 4 shows that the lamp voltage V is controlled within the range of roughly 70±10 V. The reason for the discontinuous curves of lamp voltage and lamp wattage in FIG. 4 is operation of 2 hours and 30 minutes of power with thirty-minutes of no power were carried out, similar to normal use. FIG. 4 additionally shows that by controlling the lamp wattage according to the lamp voltage the lamp voltage remains constant (i.e., that the distance between the electrodes is controlled to be constant even when projections form on the electrode tips).

Figure 5:
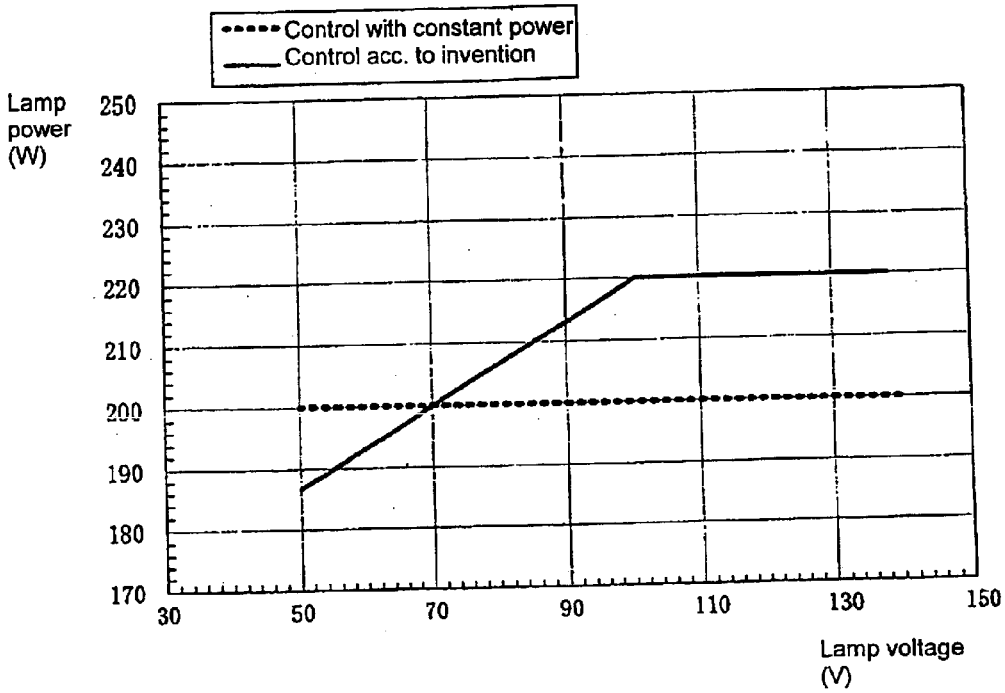
FIG. 5 shows a schematic of another example of the power control curve.

FIG. 5 shows an example of the power control curve in the case in which the given lamp voltage is 70 V and that the lamp wattage is changed linearly according to the lamp voltage with the same ratio of 6.6 W/10V as in FIG. 3. In FIG. 5, the upper boundary value of the wattage (220 W in FIG. 5) is fixed to avoid deterioration of the lamp by an overly large lamp wattage. Furthermore, the lower limit of the wattage (for example 180 W) can be fixed in order to ensure a minimum light intensity.

Figure 6:
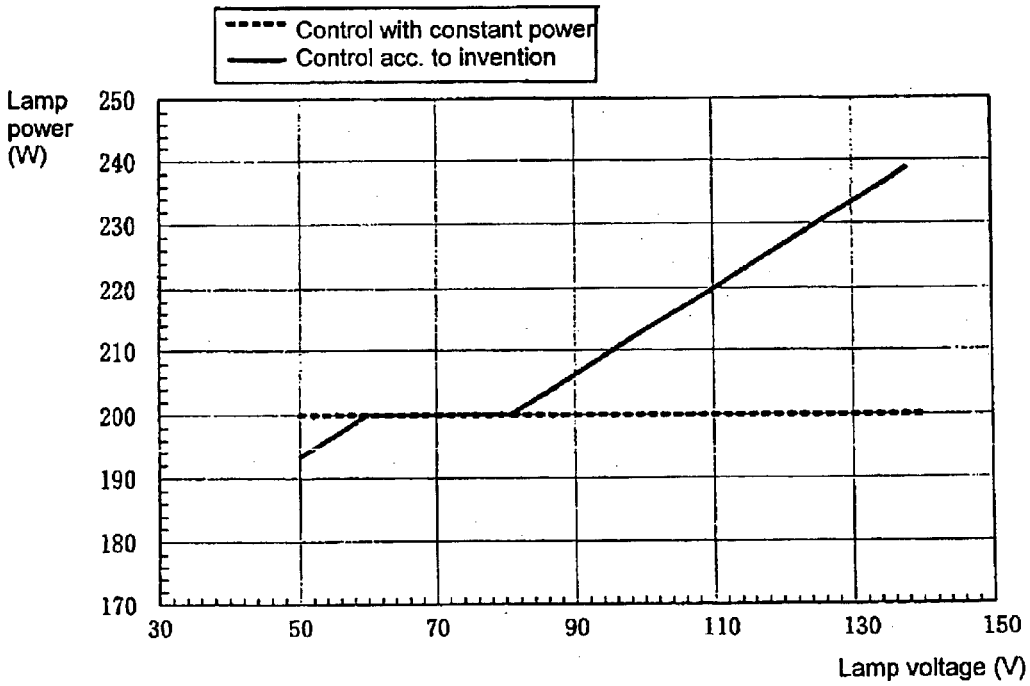
FIG. 6 shows a schematic of still another example of the power control curve.

FIG. 6 shows an example of the power control curve in the case of a slow rate of change of the lamp voltage. As is shown in FIG. 6, in the case of a low rate of change of the lamp voltage, power control can also be exercised such that in the vicinity of the given voltage, a constant wattage is achieved. The range to maintain constant wattage is, for example, roughly ±10 V of the value of the given voltage. Furthermore, as another power control curve, power control depending on the property of the rate of change of the lamp voltage cannot be carried out in the above-described linear manner, but in the manner of curve.

Specifically, if the rate of change of the lamp voltage is low in the vicinity of the given voltage, gentle power control can be exercised. Furthermore, in the case in which the given voltage is exceeded, the lamp voltage increases in an accelerated manner. At greater than or equal to the given voltage, a power control curve can also be used which runs convexly up. If the lamp voltage decreases in an accelerated manner under the certain voltage, a power control curve can also be used which runs convexly down. These power curves can be provided with at least one of an upper boundary or lower boundary of the lamp wattage for the same reason as above. Moreover, the power control curve can be formed by a combination of both a linear part and a curved part.

In order to compare to the above-described embodiment, the change of the lamp voltage by conventional operation using a wattage which stays the same is provided.

Figure 7:
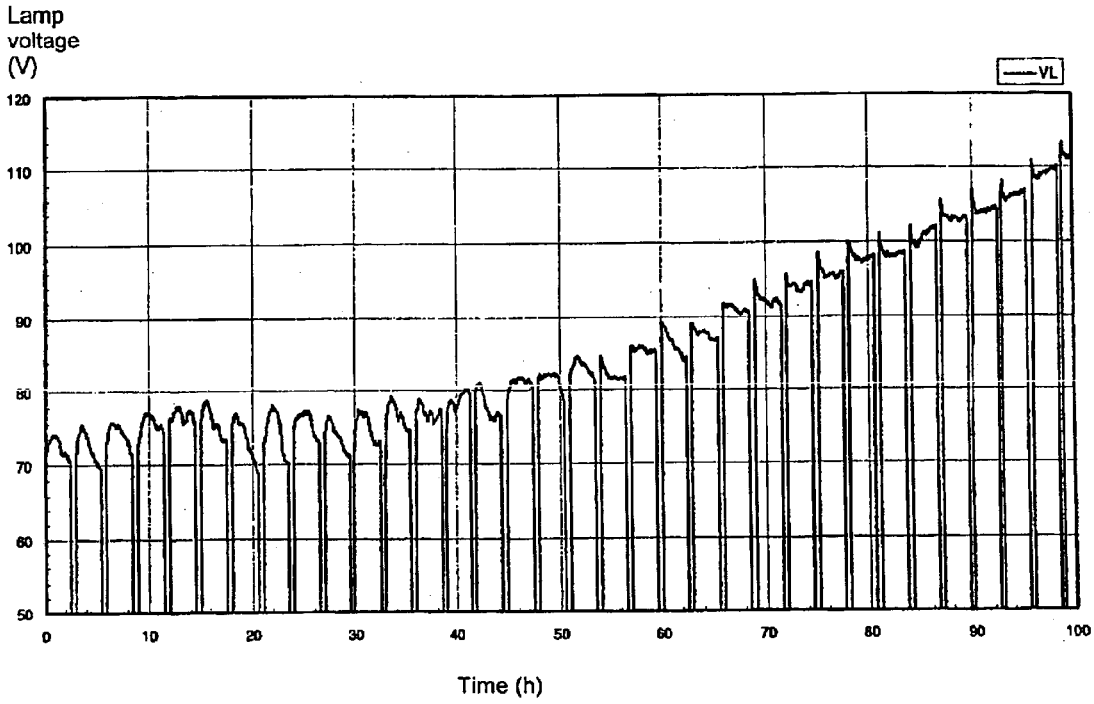
FIG. 7 shows a schematic of the change of the lamp voltage and the lamp wattage during operation by constant power control.
Figure 8:
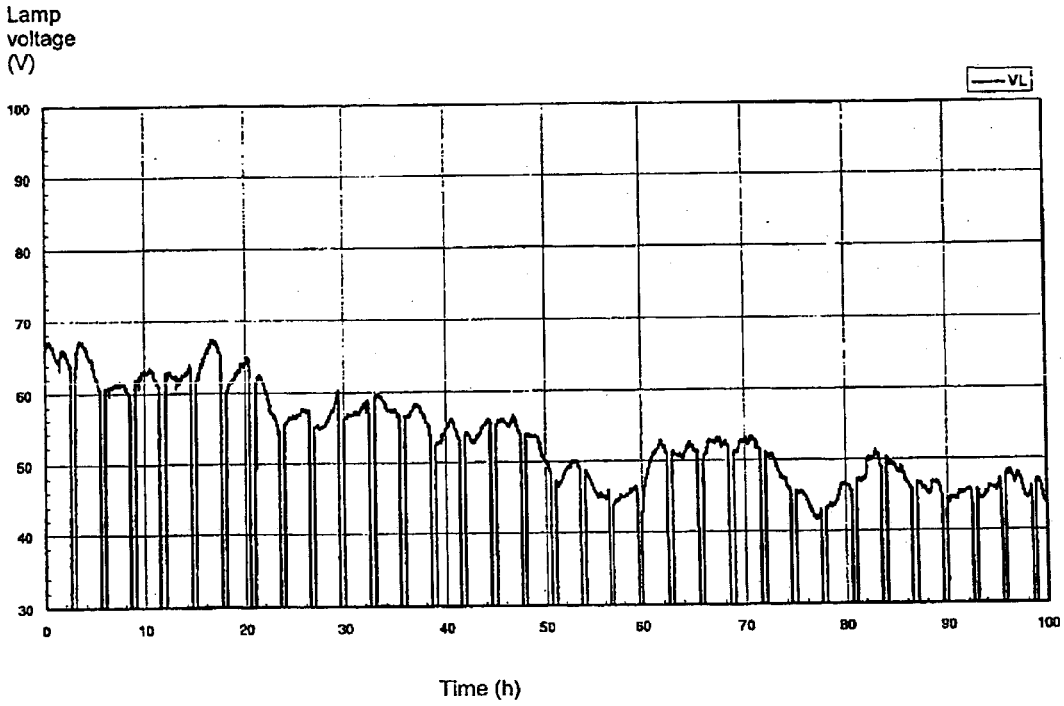
FIG. 8 shows another schematic of the change of the lamp voltage and the lamp wattage during operation by constant power control.
Figure 9:
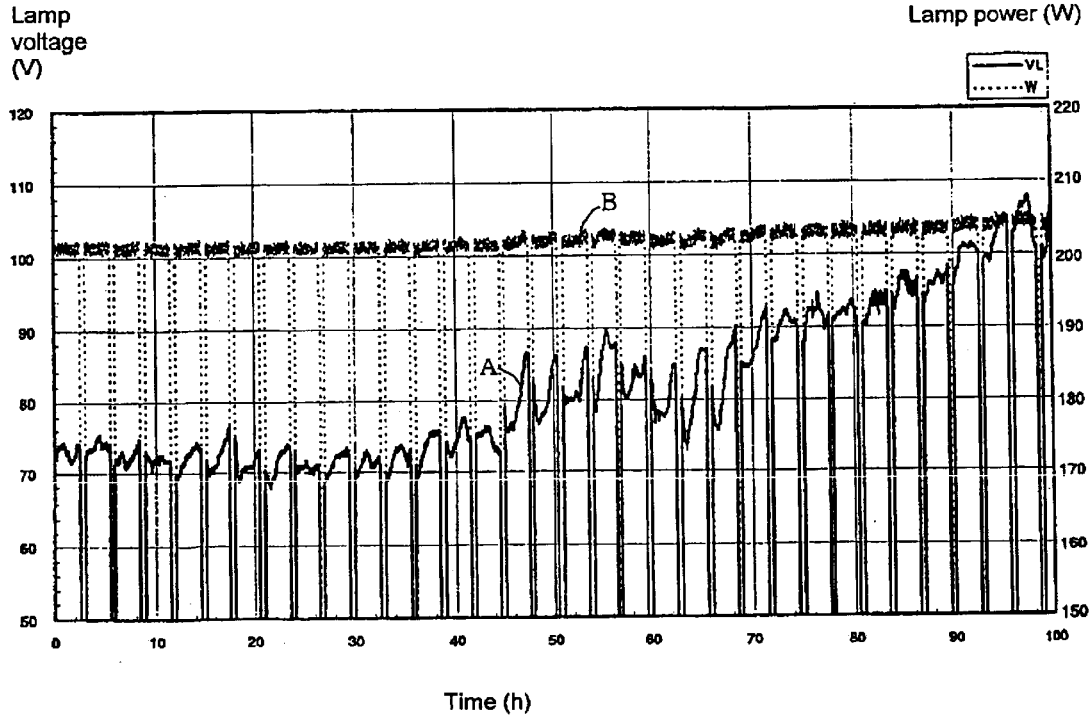
FIG. 9 shows a schematic of the change of the lamp voltage and the lamp wattage during operation by power control (0.1 W/V) in one exemplary embodiment of the invention.
Figure 10:
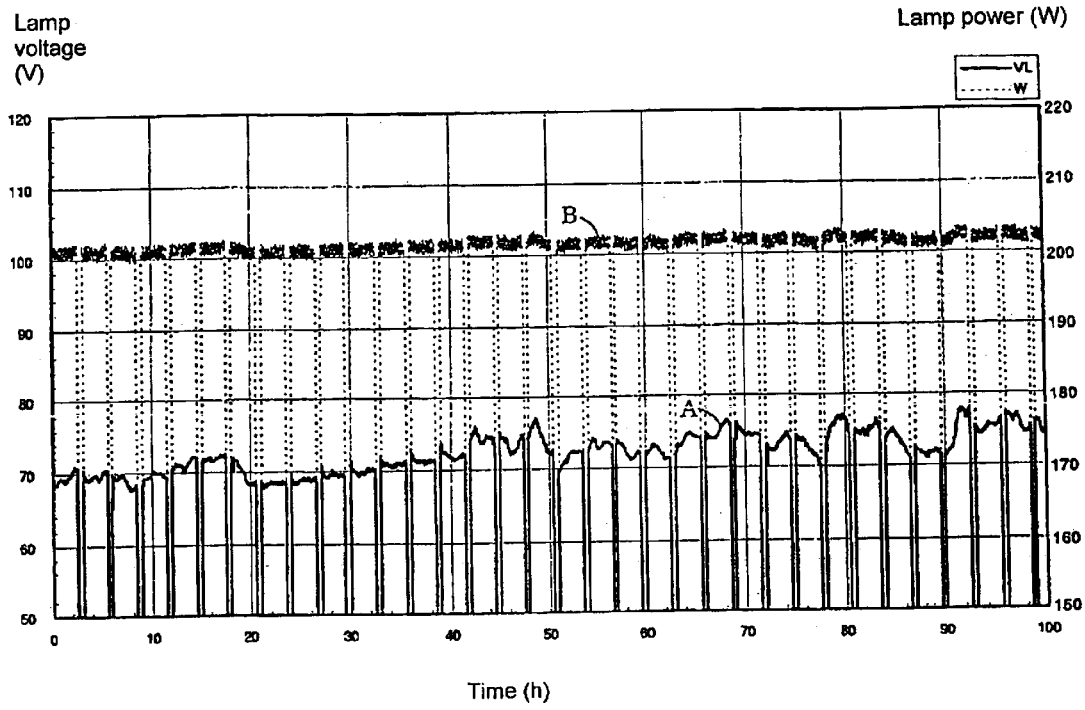
FIG. 10 shows a schematic of the change of the lamp voltage and the lamp wattage during operation by power control (0.2 W/V) in one exemplary embodiment of the invention.
Figure 11:
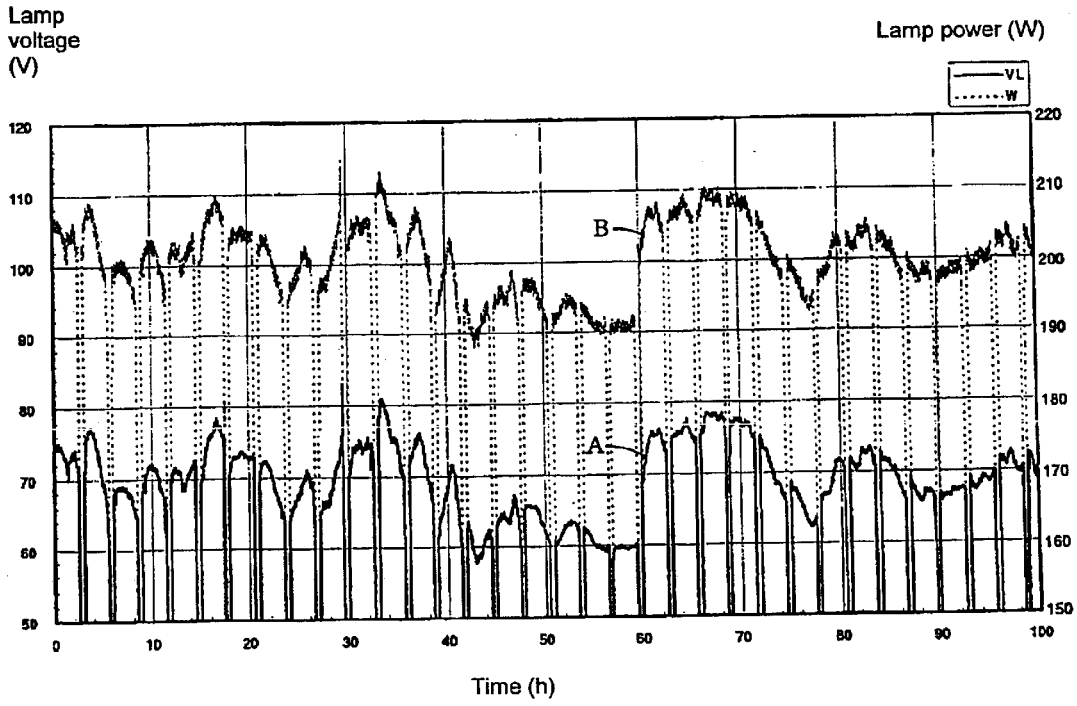
FIG. 11 shows a schematic of the change of the lamp voltage and the lamp wattage during operation by power control (1.0 W/V) in one exemplary embodiment of the invention.
Figure 12:
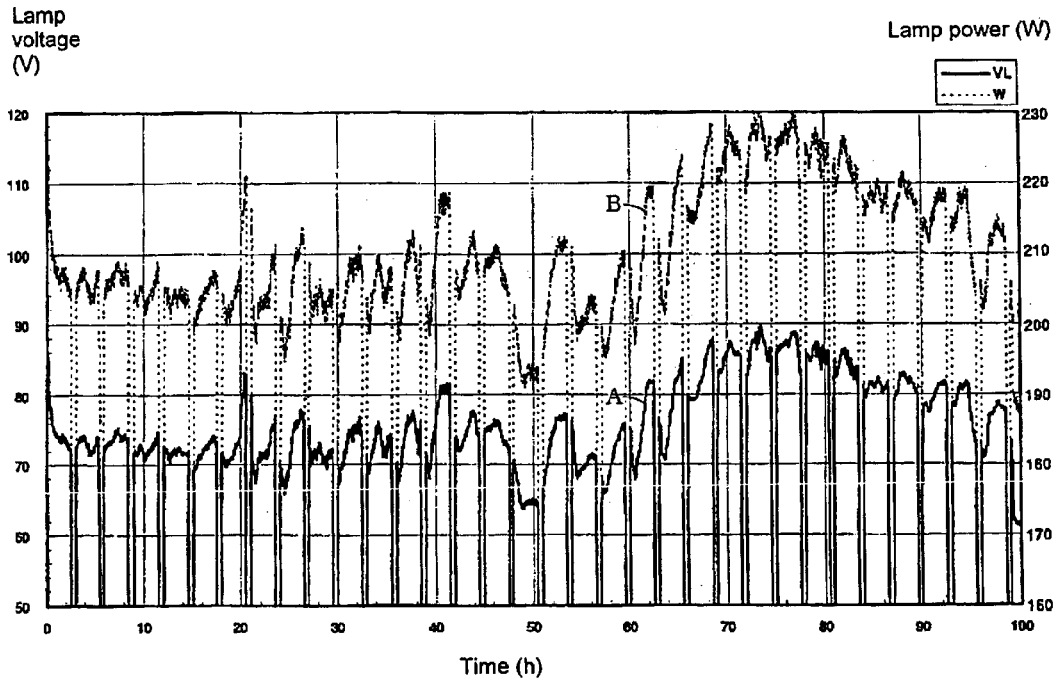
FIG. 12 shows a schematic of the change of the lamp voltage and the lamp wattage during operation by power control (1.5 W/V) in one exemplary embodiment of the invention.

FIGS. 7 & 8 show the change of the lamp voltage in the case of 100 hours of operation. In FIGS. 7 and 8 the X axis plots the running time (h) and the Y axis plots the lamp voltage. FIGS. 7 and 8 show the states of the operating voltage of the discharge lamp in the case of constant control of the discharge lamp with nominal values of 200 W and 70 V to a lamp wattage of 200 W and the illumination frequency of 150 Hz in the same manner as FIG. 4. Here, as in FIG. 4, operation of 2 hours and 30 minutes and thirty-minutes off were carried out.

FIGS. 7 & 8 show that the lamp voltage on the whole showed a rising trend (FIG. 7) or a falling trend (FIG. 8) and after 100 hours reached 110 V or 50 V. Again as described above, the reason for the discontinuous curves of the lamp voltage is due to operation of 2 hours and 30 minutes with thirty-minutes of no power.

Next, the areas of the slopes of the power control curves (FIG. 3, FIG. 5, FIG. 6) are provided in which the distance between the electrodes can be effectively controlled. A test was run using the high pressure lamp in which the ratio of the change of the illumination wattage was changed with respect to the lamp voltage and the change of the lamp voltage and the relation of the numerical values to the lamp voltage were reviewed. The lamp used in the present embodiment of the invention is an ultra-high pressure mercury lamp in which the lamp input wattage is 200 W, the normal voltage is 70 V and the normal arc length is 1 mm. The inside volume is 100 $mm^3$, the amount of added mercury per unit of volume is 0.25 $mg/mm^3$ and the amount of the added bromine is $6\times10^{-4}$ $\mu mole/mm^3$.

In the test in cases in which the illumination wattage with respect to the lamp voltage is changed linearly with ratios of 0.1 W/V, 0.2 W/V, 0.6 W/V (described in FIG. 4), 1.0 W/V and 1.5 W/V, the change of the lamp voltage was studied. The illumination frequency in all cases is 150 Hz. The results in cases of changes with the above-described ratios of 0.1 W/V, 0.2 W/V, 1.0 W/V and 11.5 W/V are shown in FIGS. 9 to 12.

The change of the illumination wattage with the ratio of 0.1 W/V (FIG. 9) is essentially identical to operation with uniform power, (i.e., the lamp voltage has, for the most part, a rising trend and the lamp voltage cannot be controlled). The changes of the illumination wattage with the ratios of 0.2 W/V, 0.66 W/V, and 1.0 W/V (FIG. 10, FIG. 4, FIG. 11) show that the fluctuation range of the lamp voltage, for the most part, becomes larger. However, in any case, the lamp voltage can be controlled to roughly 70 V, (i.e., essentially to the given value).

In the case of changing the illumination wattage with a ratio of 1.5 W/V (FIG. 12) there is a large fluctuation range of the lamp voltage. When a high lamp voltage is reached, the result is that an unduly large illumination wattage (roughly 230 W) is introduced. This can cause premature degradation of the lamp.

Based upon the above-described results, the desired ratio of the change of the illumination wattage with respect to the lamp voltage is in the range from 0.2 W/V to 1.0 W/V.

As described above, the following can be obtained in accordance with exemplary embodiments of the invention:

(1) In a device for operating a high pressure discharge lamp comprising a discharge lamp, wherein the discharge lamp further comprises a silica glass discharge vessel housing a pair of opposed electrodes separated by a distance that is less than or equal to 1.5 mm, wherein the discharge vessel is filled with at least 0.15 $mg/mm^3$ of mercury, and bromine in the range of $10^{-6}$ $\mu mol/mm^3$ to $10^{-2}$ $\mu mol/mm^3$, a feed device supplies an alternating current to operate to the discharge lamp and controls the discharge lamp such that a reduction of the operating voltage of the discharge lamp causes a reduction in the discharge wattage and an increase in the operating voltage of the discharge lamp causes an increase in the discharge wattage, and the control of the discharge wattage is carried out without interruption with respect to the change of the voltage. In this way, the lamp voltage and the distance between the electrodes can be kept constant.

(2) In a preferred embodiment, the ratio of the discharge wattage relative to the operating voltage is maintained in a range from 0.2 W/V to 1.0 W/V.

What is claimed is:

1. Device for operating a high pressure discharge lamp comprising:

a discharge lamp, wherein the discharge lamp further comprises:

a silica glass discharge vessel housing a pair of opposed electrodes separated by a distance that is less than or equal to 1.5 mm, wherein the discharge vessel is filled with at least 0.15 $mg/mm^3$ of mercury, and bromine in the range of $10^{-6}$ $\mu mol/mm^3$ to $10^{-2}$ $\mu mol/mm^3$; and a feed device that supplies an alternating current to operate the discharge lamp, wherein the feed device controls the discharge lamp such that a reduction of the operating voltage of the discharge lamp causes a reduction in the discharge wattage and an increase in the operating voltage of the discharge lamp causes an increase in the discharge wattage, and wherein the control of the discharge wattage is carried out without interruption with respect to the change of the voltage.

2. The device of claim 1, wherein a rate of change of the discharge wattage is maintained in a range from 0.2 W/V to 1.0 W/V.

3. The device of claim 1, wherein the alternating current further comprises rectangular waves.

4. Method of operating a high pressure discharge lamp which comprises a silica glass discharge vessel housing a pair of opposed electrodes separated by a distance that is less than or equal to 1.5 mm, is filled with at least 0.15 mg/mm$^3$ of mercury, and bromine in the range of $10^{-6}$ $\mu$mol/mm$^3$ to $10^{-2}$ $\mu$mol/mm$^3$; comprising the steps of:

using a feed device to supply an alternating current to operate the discharge lamp and to control the discharge lamp such that a reduction of the operating voltage of the discharge lamp causes a reduction in the discharge wattage and an increase in the operating voltage of the discharge lamp causes an increase in the discharge wattage, the control of the discharge wattage being carried out without interruption with respect to the change of the voltage.

5. The process of claim 4, wherein the control of the discharge wattage is performed so as to maintain a rate of change of the discharge wattage in a range from 0.2 W/V to 1.0 W/V.

6. The process of claim 4, wherein the alternating current is supplied with a rectangular wave form.

* * * * *